US006481497B2

(12) United States Patent
Swor et al.

(10) Patent No.: US 6,481,497 B2
(45) Date of Patent: Nov. 19, 2002

(54) HIGH TEMPERATURE HIGH PRESSURE RETRIEVABLE PACKER WITH BARREL SLIP

(75) Inventors: Loren C. Swor, Duncan, OK (US); Donald W. Winslow, Duncan, OK (US); Lee Wayne Stepp, Comanche, OK (US); Kenneth G. Neal, Duncan, OK (US); Phillip M. Starr, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/091,753

(22) Filed: Mar. 6, 2002

(65) Prior Publication Data

US 2002/0088616 A1 Jul. 11, 2002

Related U.S. Application Data

(62) Division of application No. 09/613,857, filed on Jul. 11, 2000, now Pat. No. 6,378,606.

(51) Int. Cl.[7] ..... E21B 33/129

(52) U.S. Cl. ..... 166/134; 166/119; 166/140; 166/216

(58) Field of Search ..... 166/118, 119, 166/138, 140, 134, 216, 217

(56) References Cited

U.S. PATENT DOCUMENTS 3,584,684 A * 6/1971 Anderson et al. ..... 166/129
4,156,460 A * 5/1979 Crowe ..... 166/120
5,101,897 A * 4/1992 Leismer et al. ..... 166/217
5,131,468 A 7/1992 Lane et al. ..... 166/120
5,603,511 A 2/1997 Keyser, Jr. et al. ..... 277/155
5,701,954 A 12/1997 Kilgore et al. ..... 166/119
5,944,102 A 8/1999 Kilgore et al. ..... 166/119
5,984,007 A 11/1999 Yuan et al. ..... 166/134

* cited by examiner

*Primary Examiner*—David Bagnell
*Assistant Examiner*—Zakiya Walker
(74) *Attorney, Agent, or Firm*—John W. Wustenberg; Anthony L. Rahhal

(57) ABSTRACT

A high temperature, high pressure retrievable packer adapted for service under extreme operating conditions when the packer apparatus is held in the wellbore with a mechanical slip and a barrel slip. The barrel slip has a barrel slip body with a plurality of openings defined in the outer surface of the body. Cylindrical inserts are received in the openings. The cylindrical inserts define upward facing and downward facing gripping edges that will engage casing when the barrel slip body is radially expanded. The inserts are preferably tungsten carbide inserts. A sufficient number of inserts are included along the length and around the circumference of the barrel slip so that the barrel slip can get a good grip in the casing wall. Separate metals may be used for the barrel slip body and the inserts so that a higher yield strength alloy steel may be utilized than is possible with other barrel slip arrangements.

11 Claims, 14 Drawing Sheets

HIGH TEMPERATURE HIGH PRESSURE RETRIEVABLE PACKER WITH BARREL SLIP

CROSS-REFERENCE TO RELATED APPLICATION

This application is a divisional of application Ser. No. 09/613,857 filed Jul. 11, 2000, now U.S. Pat. No. 6,378,606.

BACKGROUND OF THE INVENTION

In the course of treating and preparing subterranean wells for production, a well packer is run into the well on a work string or a production tubing. The purpose of the packer is to support production tubing and other completion equipment, such as a screen adjacent to a producing formation, and to seal the annulus between the outside of the production tubing and the inside of the well casing to block movement of fluids through the annulus past the packer location. The packer is typically provided with anchor slips having opposed camming surfaces which cooperate with complementary opposed wedging surfaces, whereby the anchor slips are radially extendible into gripping engagement against the well casing bore in response to relative axial movement of the wedging surfaces.

The packer also carries annular seal elements which are expandable radially into sealing engagement against the bore of the well casing. Longitudinal movement of the packer components which set the anchor slips and the sealing elements may be produced either hydraulically or mechanically.

After the packer has been set and sealed against the well casing bore, it should maintain sealing engagement upon removal of the hydraulic or mechanical setting force. Moreover, it is essential that the packer remain locked in its set and sealed configuration while withstanding hydraulic pressure applied externally or internally from the formation and or manipulation of the tubing string and service tools without unsetting the packer or interrupting the seal. This is made more difficult in deep wells in which the packer and its components are subjected to high downhole temperatures, for example temperatures up to and exceeding 400° F., and high downhole pressures, for example, 5,000 pounds per square inch ("psi"). The packer should be able to withstand variation of externally applied hydraulic pressures at levels up to as much as 15,000 psi in both directions.

There are packers that are designed to withstand such extreme conditions, but such packers are intended to be set and left in the hole for a long period of time. For example, U.S. Pat. No. 5,944,102 to Kilgore et al. is directed to a high temperature high pressure retrievable packer which is designed to be utilized in wells with extreme conditions and to be retrievable after exposure for long periods. The packer disclosed therein is not, however, suited to be set in the hole, unset and reset repetitively in the well. U.S. Pat. No. 6,102,117 (the '117 patent) directed to RETRIEVABLE HIGH PRESSURE HIGH TEMPERATURE PACKER APPARATUS WITH ANTI-EXTRUSION SYSTEM and assigned to the assignee of the present invention, the details of which are incorporated herein by reference, discloses an embodiment of a high pressure high temperature packer apparatus that can be set, unset and reset in the well and will maintain a seal each time it is reset. With conventional mechanical slips, like that shown in the '117 patent, load applied in high temperature high pressure packer settings is such that the casing can be damaged. The conventional slip shown therein makes deep penetration marks in the casing, which can negatively impact the casing integrity and the life of the casing. Thus, there is a continuing need for a high temperature, high pressure packer which can be set and reset a number of times and which will lessen casing damage each time the packer is set.

SUMMARY OF THE INVENTION

The present invention provides a retrievable packer apparatus that can be alternated between set and unset positions in a wellbore and can maintain sealing engagement with casing disposed in the wellbore each time it is set at temperatures as high as and exceeding 400° F. and pressures as high as 15,000 psi. The packer apparatus includes a barrel slip and a mechanical slip that will engage and hold the packer apparatus in the wellbore while minimizing any damage to the casing from the slip engagement with the casing. The apparatus further includes a novel liner lock to prevent the packer apparatus from prematurely moving from an unset to a set position.

The packer apparatus includes a packer mandrel and has a seal assembly disposed about the packer mandrel. The packer apparatus further includes a barrel slip and a mechanical anchor slip disposed about the mandrel below the seal assembly. Upper and lower barrel slip wedges are disposed about the packer mandrel above and below the barrel slip. The upper and lower barrel slip wedges are capable of applying load transmitted thereto to the center of the barrel slip such that the barrel slip will be expanded radially outwardly so that it will engage casing in the wellbore. The mechanical slip is disposed about the packer mandrel below the barrel slip. The purpose of the lower mechanical slip is to offer initial grip to the casing so that the barrel slip can be engaged to grip the casing to hold the tool when high loads are applied.

The barrel slip includes a barrel slip body having a plurality of openings defined in an outer surface thereof. A plurality of inserts are received in the barrel slip body. The openings are oriented such that the inserts define a plurality of upward facing and downward facing gripping edges. Thus, once the barrel slip is expanded radially outwardly, the inserts will engage the casing in the well and the barrel slip will prevent both upward and downward movement in the well. The radial expansion of the barrel slip is described in more detail in U.S. Pat. No. 5,944,102 (the '102 patent) to Kilgore et al. issued Aug. 31, 1999, the details of which are incorporated herein by reference. The barrel slip body has a sufficient number of inserts disposed along the length and about the circumference thereof such that the barrel slip will get a good grip in the casing and will spread the slip to casing load over a large area to minimize slip to casing contact stresses.

Prior to the setting of the barrel slip, downward movement of the mandrel will cause the mechanical slip to engage the casing. Inadvertent or premature setting of the mechanical and barrel slips is prevented by a liner lock which is operably associated with a drag block assembly disposed about the mandrel below the mechanical slip. The liner lock comprises an arm pivotably attached to the drag block sleeve. The arm engages the mandrel when the packer apparatus is in an initial running position. Compression of the drag block sleeve will cause the arm to pivot and disengage from the mandrel so that the packer mandrel can move to cause radial expansion of the mechanical slip, barrel slip and seal assembly to move the packer apparatus into its set position. The packer apparatus can be moved between its set and unset positions as many times as desired prior to removing the packer apparatus from the well. Each time the packer apparatus is moved to its set position, the mechanical and barrel slip will engage the casing to hold the apparatus, and whatever is attached thereto in the well, and the seal assembly will seal against the casing.

The novel features of the invention are set forth with particularity in the claims. The invention will be best understood from the following description when read in conjunction with the accompanying drawings.

BRIEF DESCRIPTION OF THE DRAWINGS

FIG. 6 is a section view from line 6—6 of FIG. 10 and includes barrel slip inserts.

FIG. 9 is a partial section view of the drag block assembly taken 90° from the section view of FIG. 2G.

DESCRIPTION OF THE PREFERRED EMBODIMENT

Figure 1A:
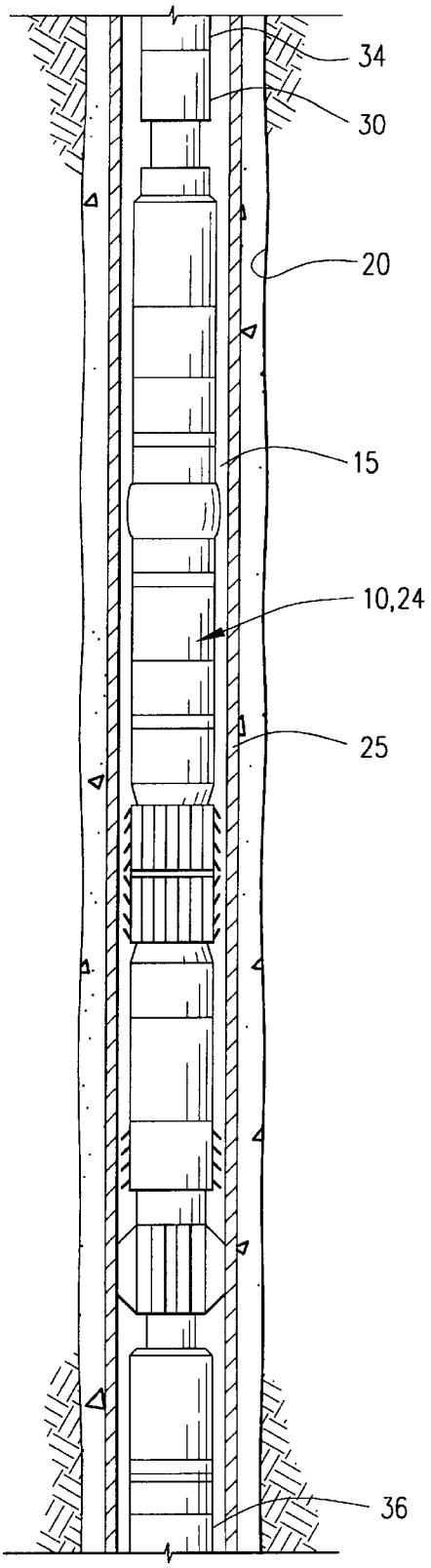
FIGS. 1A and 1B schematically show the packer apparatus disposed in a well bore in an unset and a set position, respectively.

In the description that follows, like parts are marked throughout the specification and drawings with the same reference numerals, respectively. The drawings are not necessarily to scale and the proportions of certain parts have been exaggerated to better illustrate details and features of the invention. In the following description, the terms "upper," "upward," "lower," "below," "downhole" and the like as used herein shall mean in relation to the bottom or furthest extent of the surrounding wellbore even though the wellbore or portions of it may be deviated or horizontal. The terms "inwardly" and "outwardly" are directions toward and away from, respectively, the geometric axis of a referenced object. Where components of relatively well-known design are employed, their structure and operation will not be described in detail.

Figure 1B:
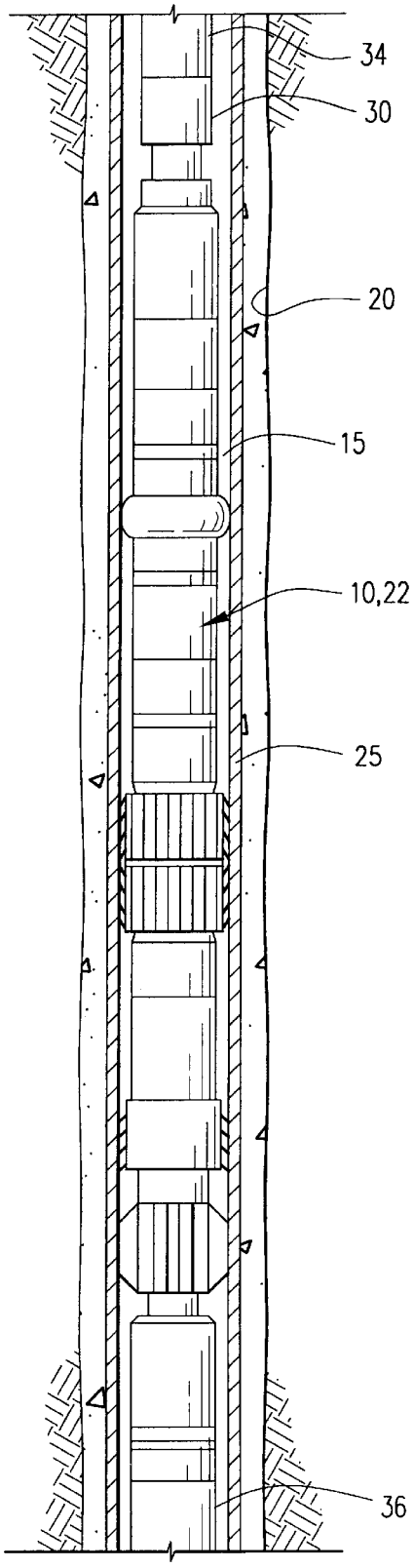
Figure 2A:
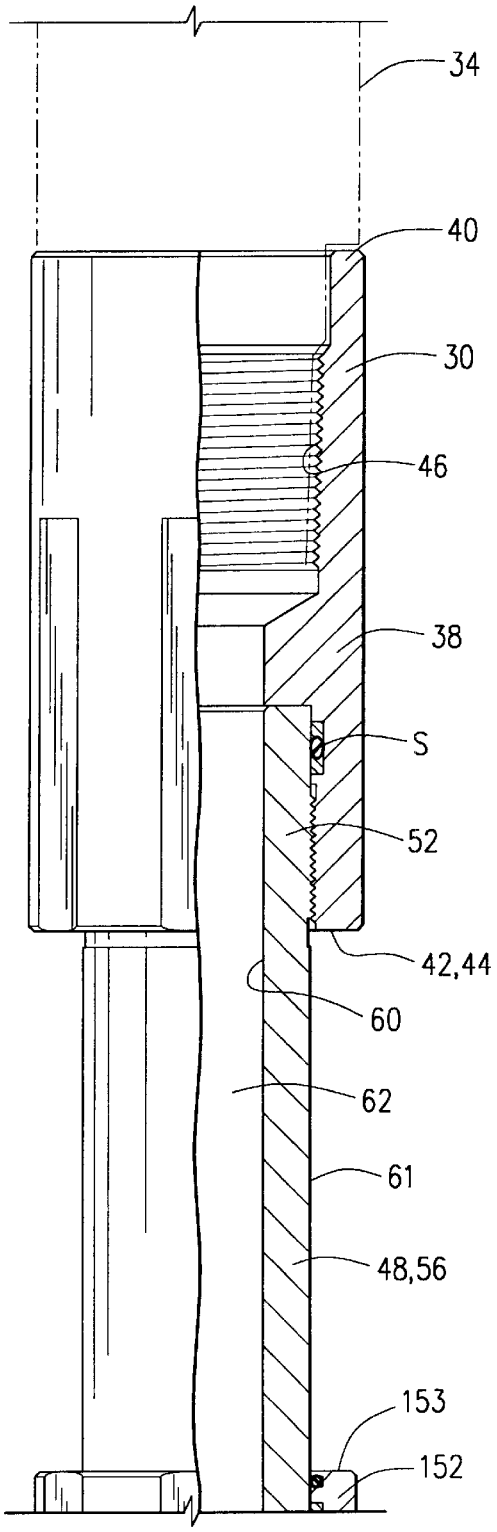
FIGS. 2A through 2H show a partial section view of the packer apparatus in an unset position with the slips retracted.
Figure 2B:
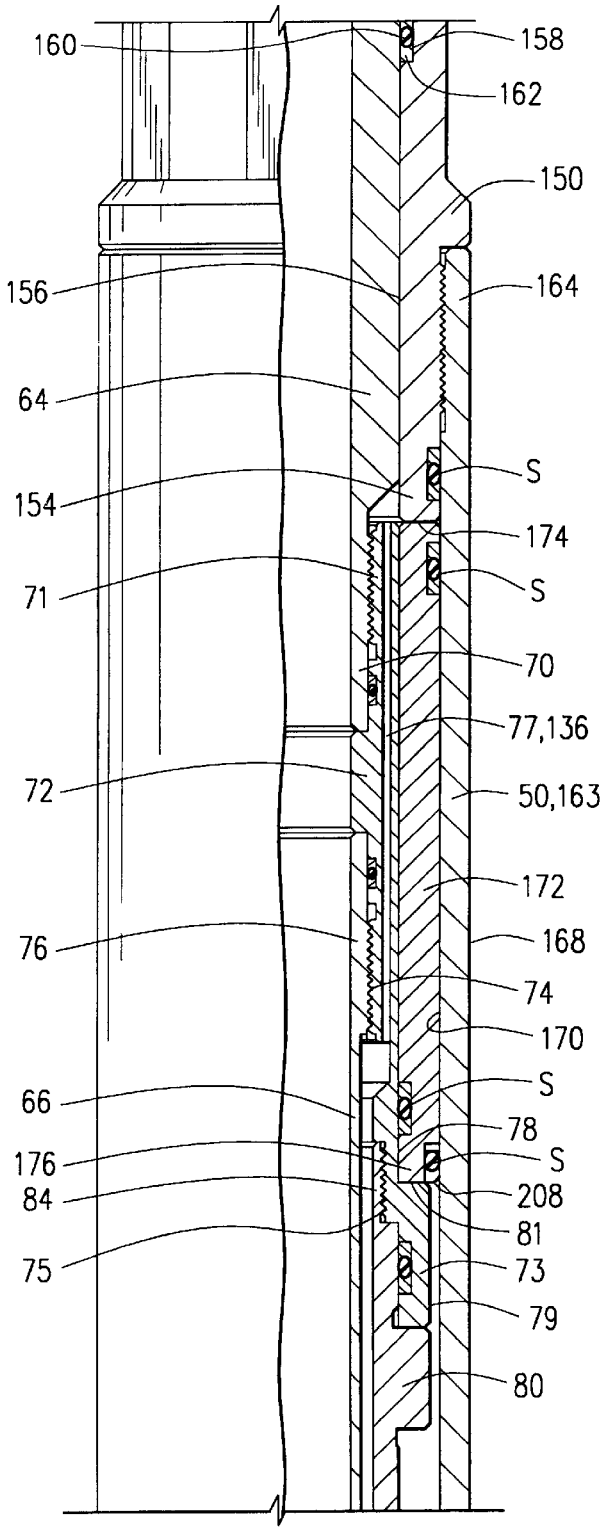
Figures 2C, 2D:
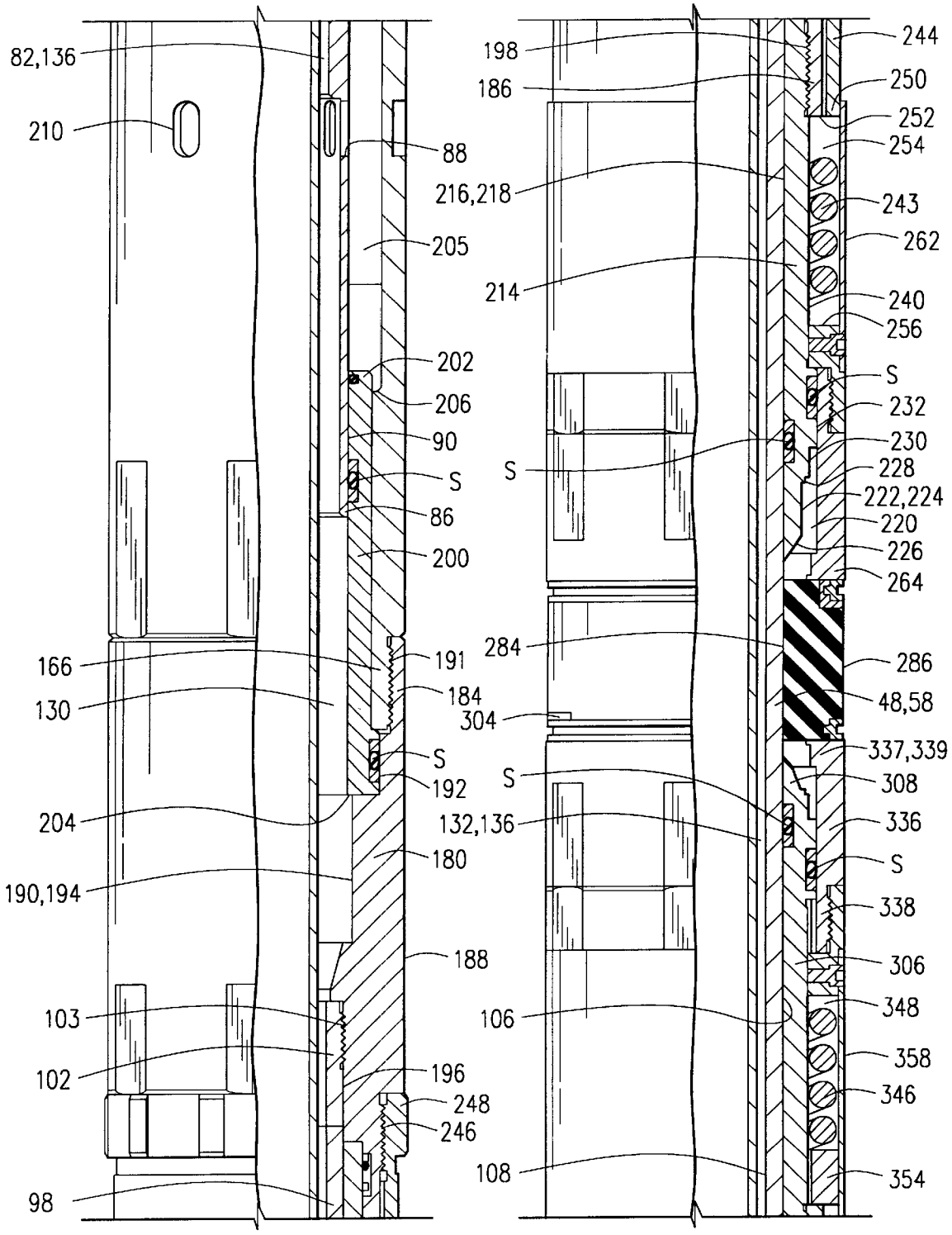
Figure 2E:
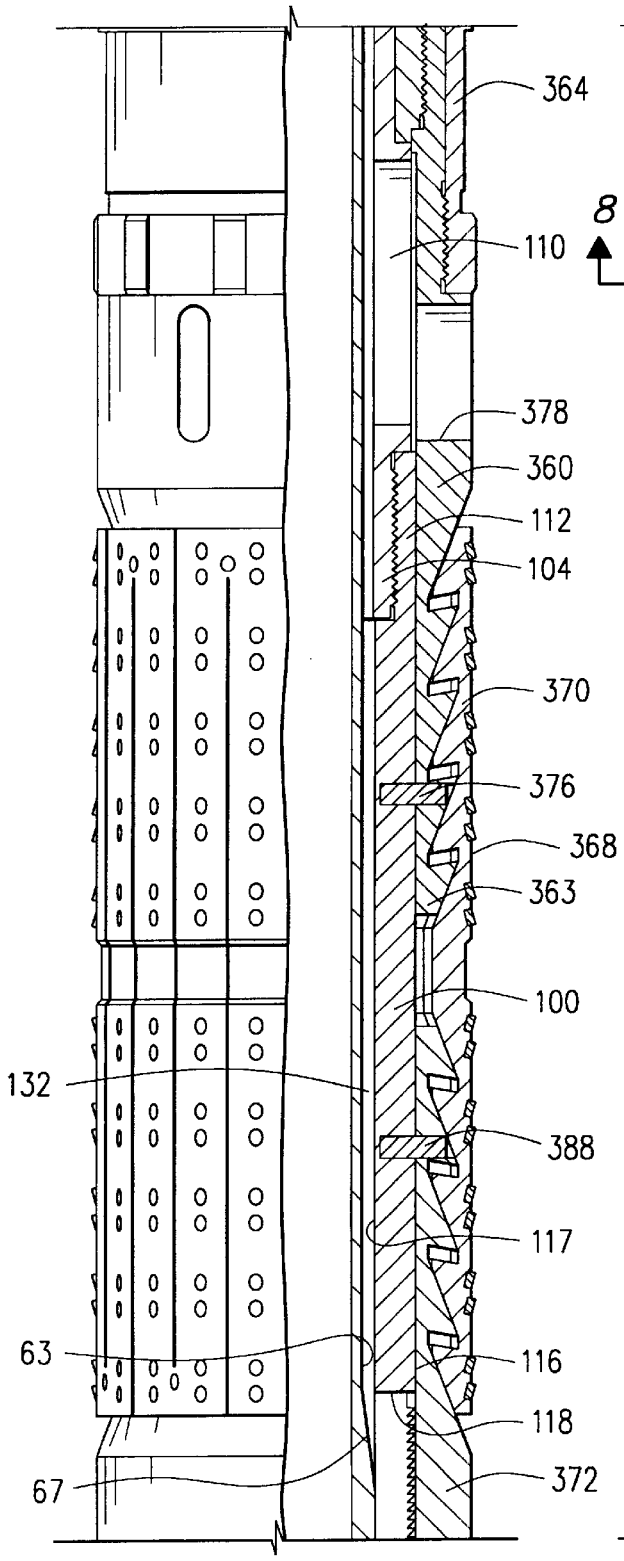
Figure 2F:
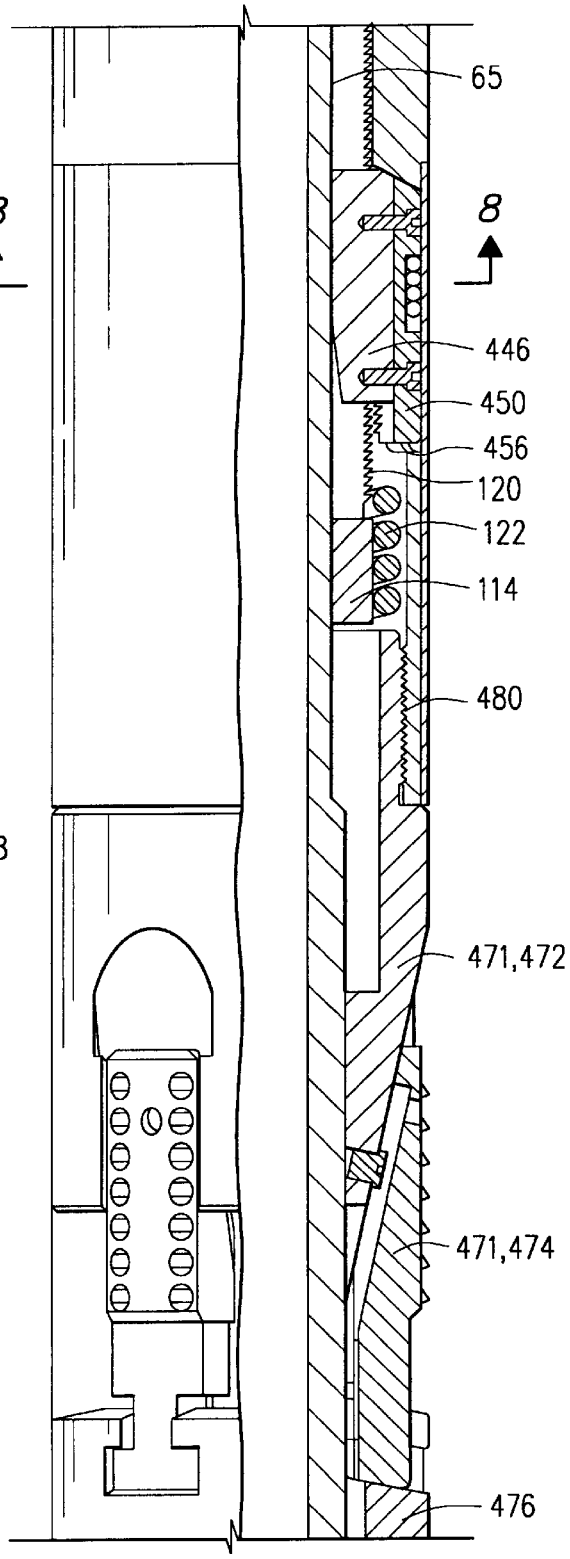
Figure 2G:
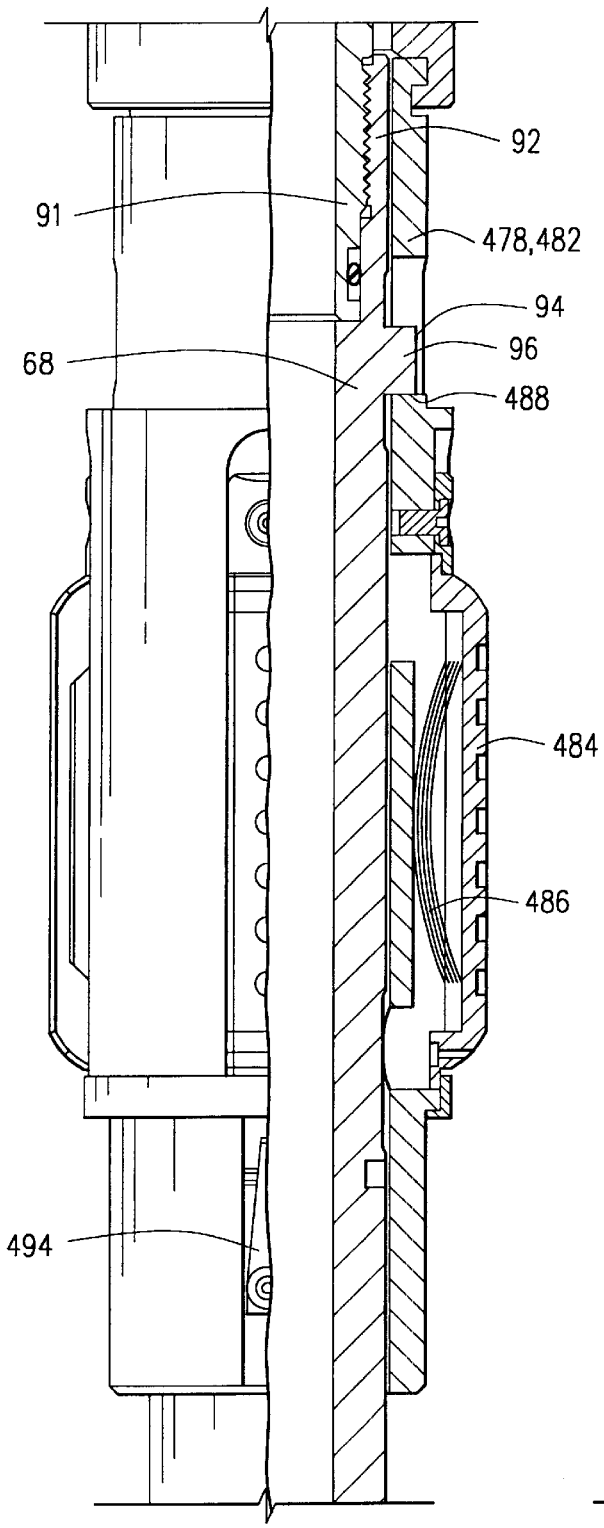
Figure 2H:
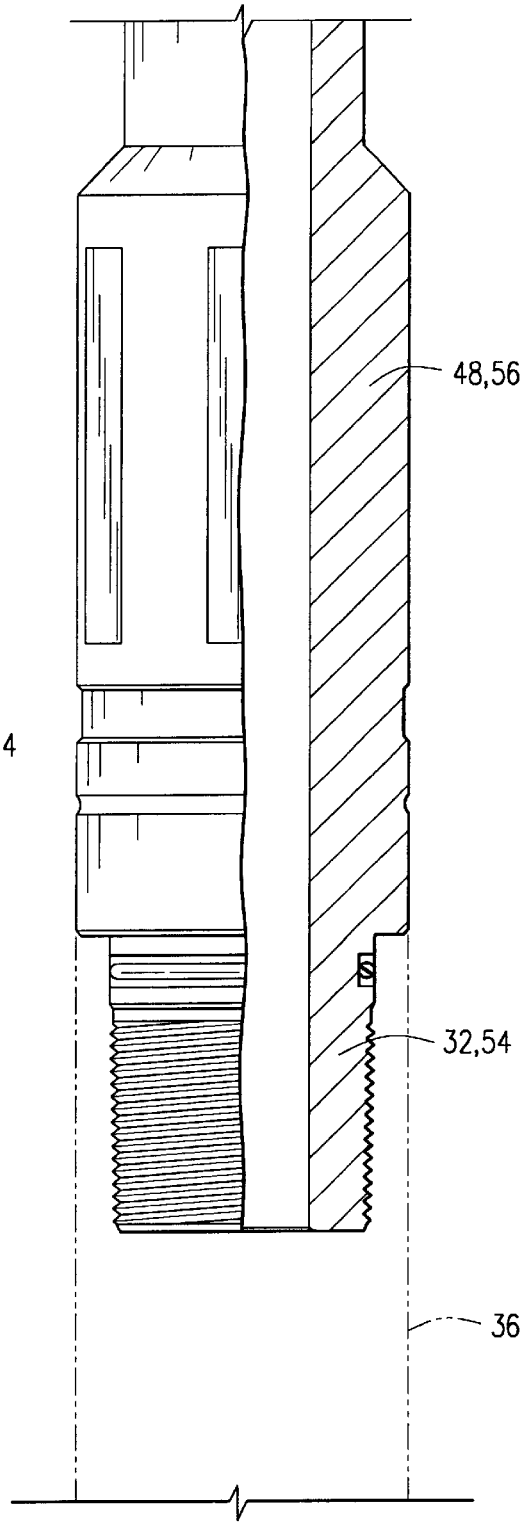
Figure 3A:
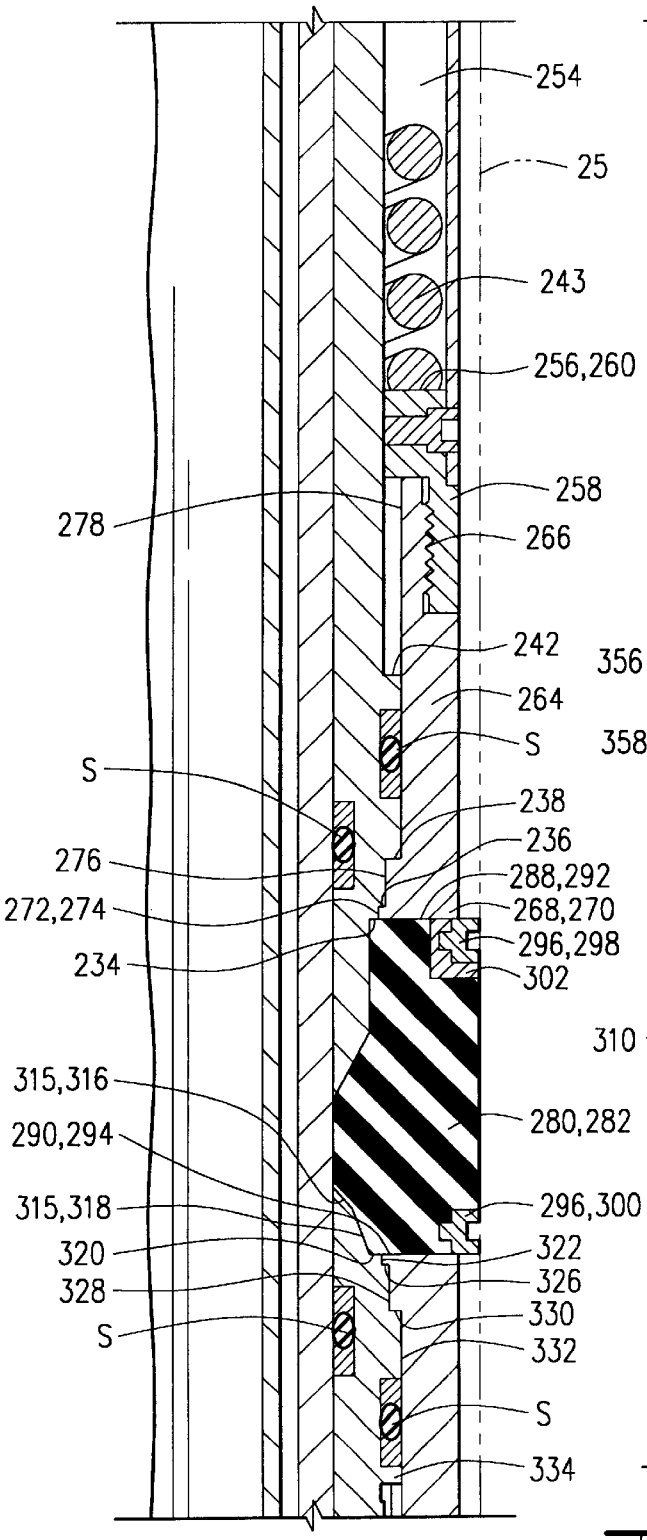
FIGS. 3A through 3F show partial section views of components of the packer apparatus in the set position with the slips deployed.
Figure 3B:
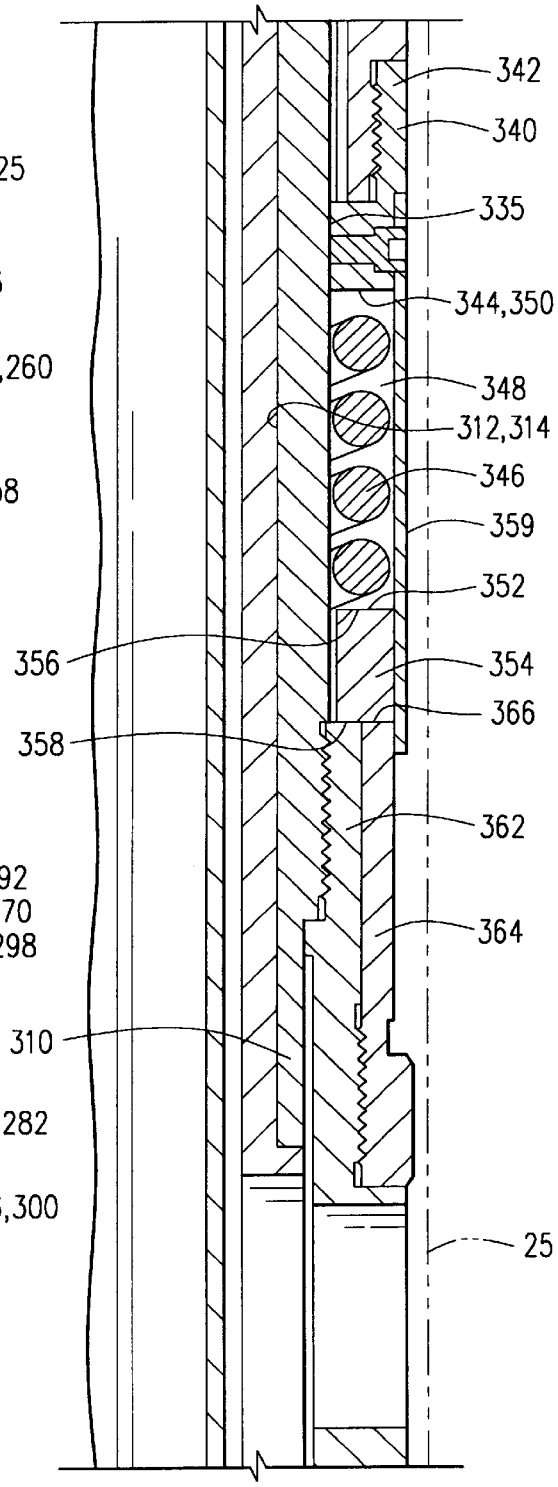
Figure 3C:
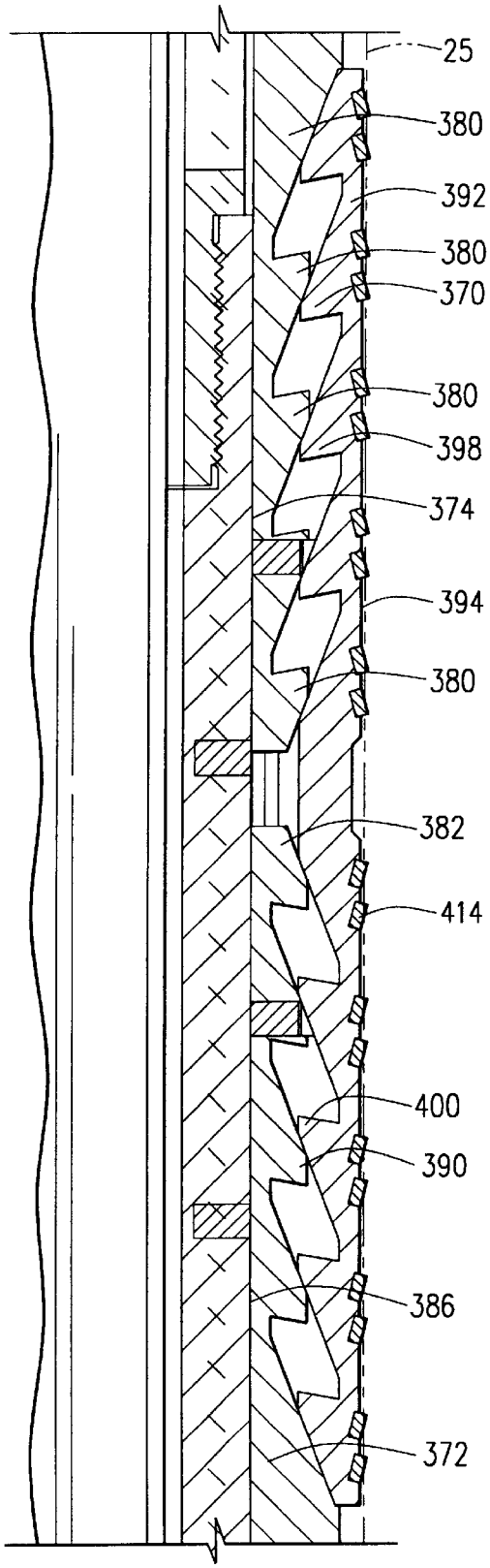
Figure 3D:
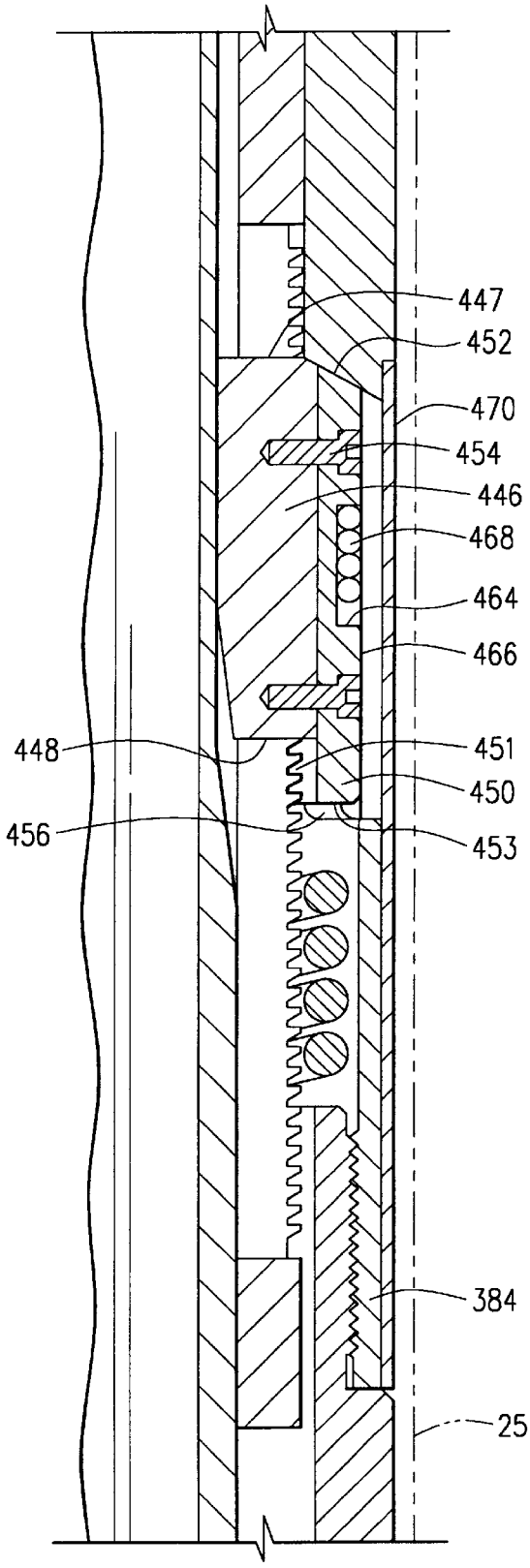
Figure 3E:
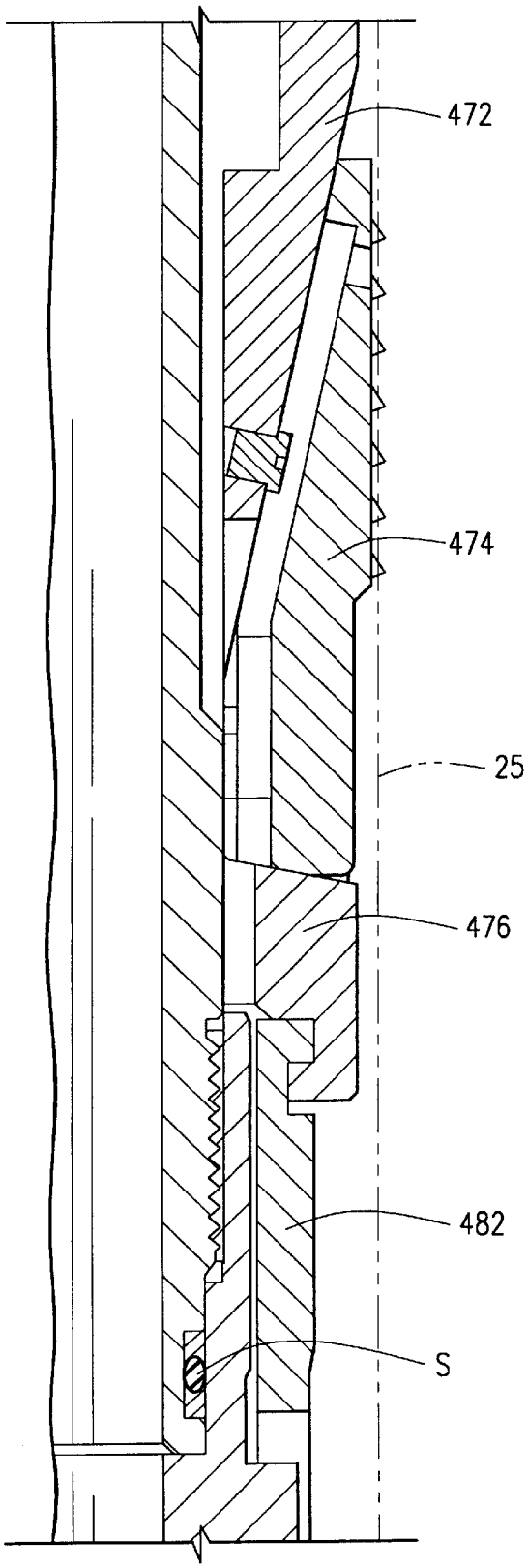
Figure 3F:
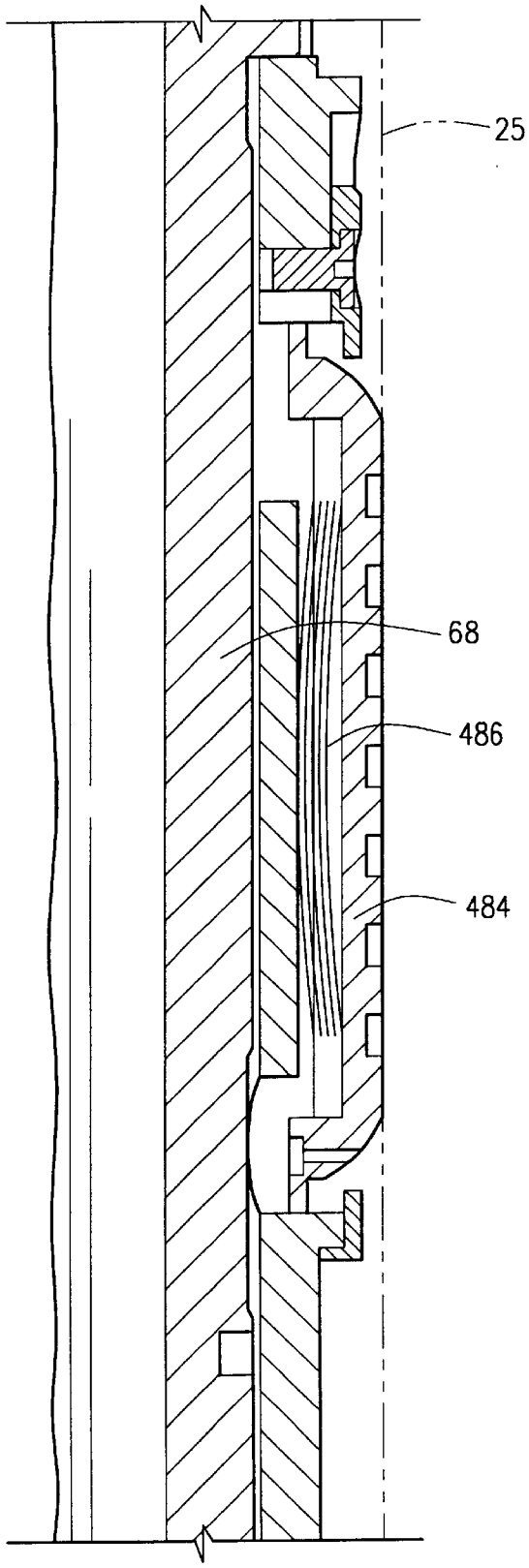
Figure 4:
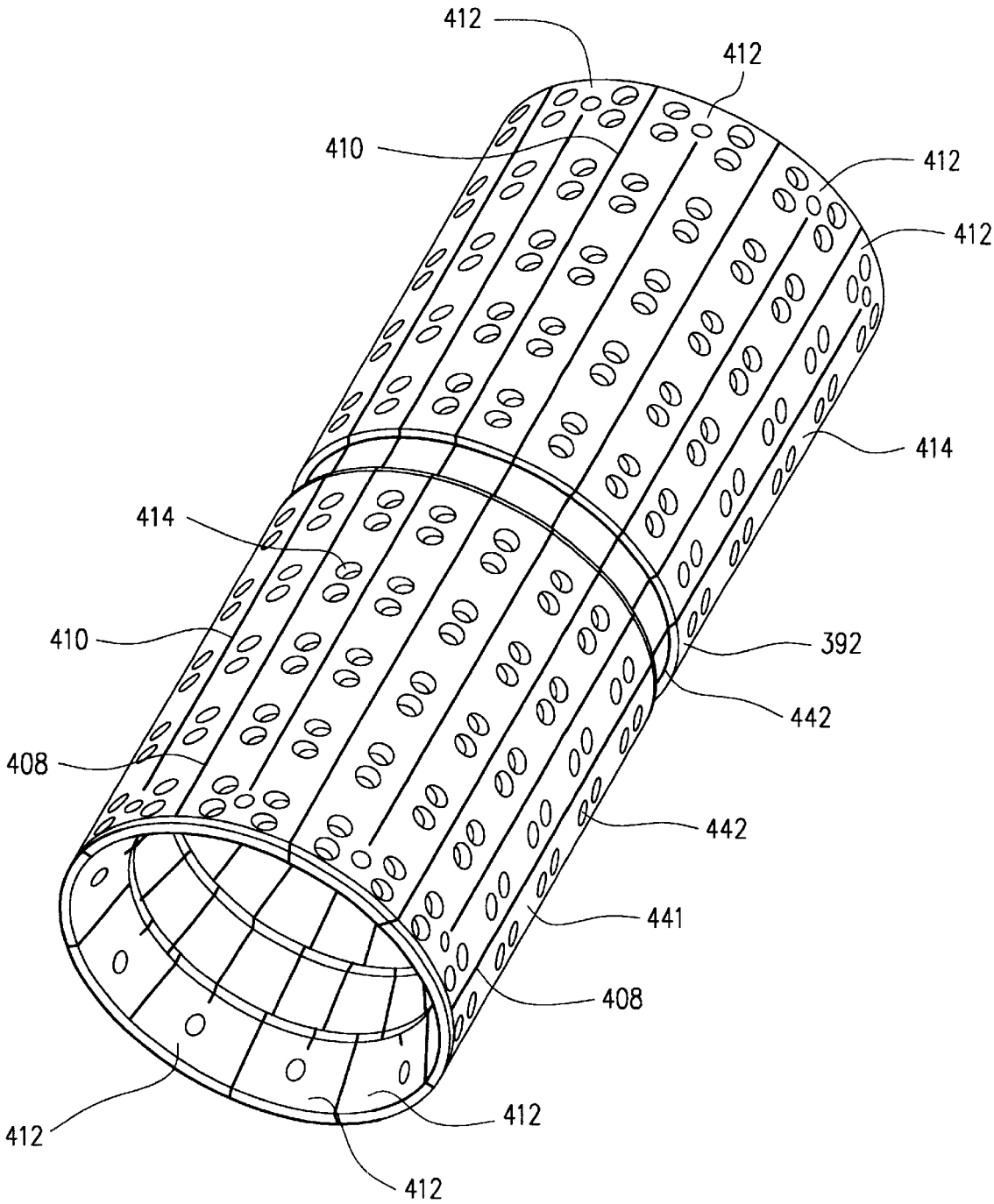
FIG. 4 is a perspective view of the barrel slip body of the barrel slip used in connection with packer apparatus.
Figure 5:
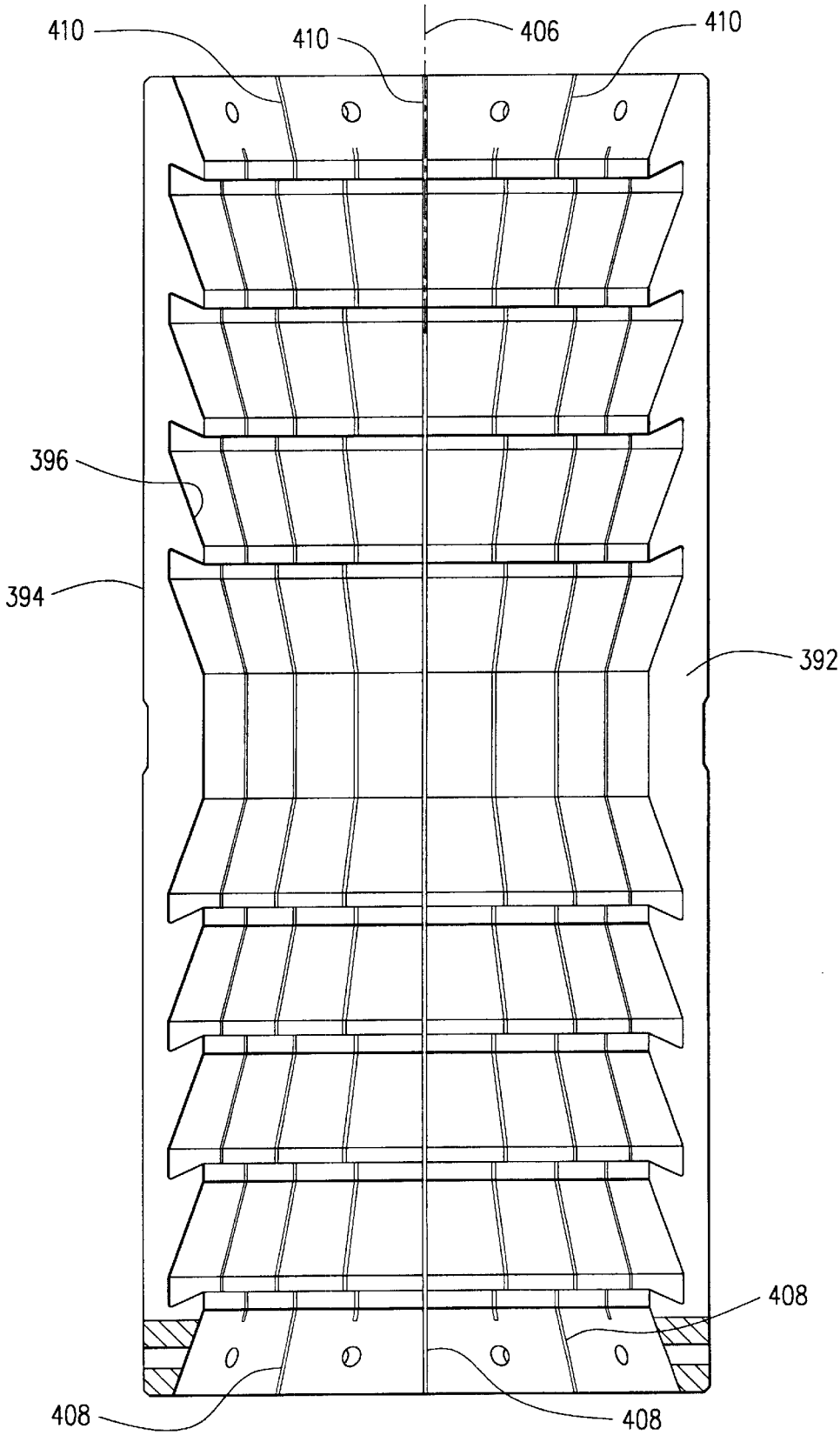
FIG. 5 is a section view from line 5—5 of FIG. 10.

Referring now to the drawings, and more specifically to FIGS. 1A and 1B, a well packer or packer apparatus 10 is schematically shown lowered into a well 15. Well 15 comprises a wellbore 20 having a casing 25 disposed therein. Packer apparatus 10 is schematically shown in its set position 22 in FIGS. 1B, 3A–3F. Packer 10 is shown in its unset, running position 24 in FIGS. 1A, 2A–2H and has an upper end 30 and a lower end 32. Upper end 30 is adapted to be connected to a work string, or tubing string 34 of a type known in the art to be flowered into and moved within the well 15 thereon. Lower end 32 is adapted to be connected to downhole equipment and/or tools 36 utilized in the course of treating and preparing wells for production or to production tubing and/or other production equipment, such as but not limited to production screens, polished nipples and tail screens.

Packer apparatus 10 has an adapter 38 at the upper end thereof. Adapter 38 has an upper end 40 and a lower end 42 defining a downward facing shoulder 44. Adapter 38 has threads 46 defined therein for connecting to tubing 34.

Packer apparatus 10 further comprises a mandrel 48 and packer body 50 disposed about mandrel 48. Mandrel 48 has an upper end 52 and a lower end 54. Upper end 52 is threadedly connected to adapter 38 and lower end 54 is adapted to be connected to downhole equipment therebelow. Mandrel 48 has an inner mandrel 56 and an outer mandrel 58. Upper end 52 of mandrel 48 comprises the upper end of inner mandrel 56 and lower end 54 comprises lower end of inner mandrel 56. Inner mandrel 56 has an inner surface 60 defining a longitudinal flow passage 62 for the communication of fluids therethrough, and has an outer surface 61.

Inner mandrel 56 includes an upper portion 64, central portion 66 and a lower portion 68. Outer surface 61 of inner mandrel 56 on central portion 66 defines outer diameters 63 and 65 having a ramp 67 therebetween. Diameter 65 has a magnitude greater than diameter 63 and is thus displaced radially outwardly therefrom. Upper portion 64 is connected at a lower end 70 thereof to a coupling 72 having an upper end 71 and a lower end 73. Coupling 72 is connected at threaded connection 74 to an upper end 76 of central portion 66 of inner mandrel 56. A longitudinal flow passage 77 is defined through coupling 72. Coupling 72 has first and second outer diameters 78 and 79 defining a shoulder 81 therebetween.

A ported housing 80 is disposed about central portion 66 of mandrel 56 and is connected to coupling 72 at threaded connection 75. A longitudinal flow passage 82 is defined by and between ported housing 80 and outer surface 61 of inner mandrel 56. Longitudinal flow passage 82 is communicated with longitudinal passage 77. Ported housing 80 has an upper end 84 and a lower end 86. Ported housing 80 has a plurality of pores 88 disposed therethrough about the circumference thereof communicated with longitudinal flow passage 82. Ported housing 80 has an outer surface 90 and is sealingly received in a bypass sleeve 200 which is a part of packer body 50.

Central portion 66 of inner mandrel 56 is threadedly connected at a lower end 91 thereof to an upper end 92 of lower portion 68. Lower portion 68 has an outer surface 94 defining at least one, and preferably two radially outwardly extending lugs 96. Lugs 96 are separated by 180° around the circumference of lower portion 68 of inner mandrel 56.

Outer mandrel 58 comprises an upper portion 98 and a lower portion 100 which may also be referred to as a ratchet mandrel 100. Upper portion 98 has an upper end 102, a lower end 104, an outer surface 106 and an inner surface 108. Outer mandrel 58 is threadedly connected to packer body 50 at threaded connection 103. A plurality of radial ports 110 are defined through upper portion 98. Upper portion 98 is threadedly connected to an upper end 112 of ratchet mandrel 100 at the lower end 104 thereof. Ratchet mandrel 100 has a lower end 114, an outer surface 116 and an inner surface 117. A plurality of slots 118 are spaced around the circumference of ratchet mandrel 100. Preferably, ratchet mandrel 100 has four slots 118 defined therethrough. A plurality of ratchet teeth, or ridges 120 are defined on ratchet mandrel 100 between slots 118. A ratchet load spring 122 is disposed about ratchet mandrel 100 at the lower end thereof.

An annular passageway 130 is defined by and between mandrel 48 and packer body 50 between the lower end 86 of ported housing 80 and the upper end 102 of upper portion 98 of outer mandrel 58. An annular passageway 132 is defined by outer surface 61 of inner mandrel 56 and by inner surfaces 108 and 117 of upper portion 98 and ratchet mandrel 100, respectively. Passageways 77, 82, 130 and 132 comprise an annular passageway 136.

Packer body 50 includes a cap 150 having an upper end 152 and a lower end 154. Upper end 152 defines an upward facing shoulder 153. Cap 150 has an inner surface 156 and is disposed about upper portion 64 of inner mandrel 56. Cap 150 is sealingly disposed about mandrel 48 and thus has a groove 158 with an O-ring seal 160 and back-up seals 162 disposed therein to sealingly engage mandrel 48. There are a number of locations along the length of packer apparatus 10 wherein seals have been disposed in grooves defined in the inner or outer surface of mating parts. Rather than specifically identify each seal, seals will be designated by the letter "S" and it will be understood that such seals may include O-ring seals, back-up seals and other any type of seal known in the art utilized to create a seal between mating parts. Designation by the letter "S" does not indicate that all seals are identical, but simply that seals of a type known in the art may be utilized.

Packer body 50 further comprises a packer body sub 163 having an upper end 164 and a lower end 166. Packer body sub 163 is threadedly connected at its upper end to cap 150. Packer body sub 163 has an outer surface 168 and an inner surface 170. A floating piston 172 is sealingly disposed in the annular space between packer sub 163 and coupling 72. Floating piston 172 is positioned between lower end 154 of cap 150 and upward facing shoulder 81 defined by coupling 72. Floating piston 172 has an upper end 174 and a lower end 176.

Packer body sub 163 is threadedly connected at its lower end 166 to a coupling shoe 180. Coupling shoe 180 has an upper end 184, a lower end 186, an outer surface 188 and an inner surface 190. Inner surface 190 defines an upper threaded diameter 191 which threadedly connects coupling shoe 180 to packer body sub 163, a first inner diameter 192, a second inner diameter 194 spaced radially inwardly from diameter 192, a third inner diameter 196 spaced radially inwardly from diameter 194 and a lower threaded diameter 198.

A bypass sleeve 200 having an upper end 202 and lower end 204 is disposed between packer body sub 163 and ported housing 80. An inner surface of bypass sleeve 200 sealingly engages ported housing 80. Outer mandrel 58 is threadedly connected at its upper end 102 to third inner diameter 196. Bypass sleeve 200 extends longitudinally such that the lower end thereof is positioned below lower end 166 of packer sub 163 land sealingly engages first inner diameter 192 of coupling shoe 180. An annular passageway 205 having a lower end 206 and an upper end 208 defined by lower end 176 of floating piston 172 is defined between packer body sub 163 and at a radially inner boundary by ported housing 80 and coupling 72. A plurality of radial ports 210 are defined in packer body sub 163 and communicate well 15 with annular passageway 205. Annular passageway 205 is in turn communicated with annular passageway 136 through ports 188 in ported housing 80.

An upper slide wedge 214 is disposed about upper portion 98 of outer mandrel 58. Upper slide wedge 214 has an inner surface 216 defining an inner diameter 218, and is closely and sealingly received about outer packer mandrel 58. Upper slide wedge 214 has a lower end 220 and a first outer, or seal engagement surface 222 defining a first outer diameter 224 that is located radially outwardly from outer surface 106 of upper portion 98 of outer mandrel 58.

A ramp or ramp surface 226 is provided on upper slide wedge 214 between inner surface 216 and first outer diameter 224. Upper slide wedge 214 has a second outer diameter 228 located above and displaced radially outwardly from first outer diameter 224, a third outer diameter 230 located above and displaced radially outwardly from second outer diameter 228 and a fourth outer diameter 232 located above and displaced radially outwardly from third outer diameter 230. A first downward facing shoulder 234 is defined between first and second outer diameters 222 and 228, respectively. A second downward facing shoulder 236 is defined by and extends between second and third outer diameters 228 and 230, respectively. Finally, a third downward facing shoulder 238 is defined by and extends between third and fourth outer diameters 230 and 232, respectively. Upper slide wedge 214 has a fifth outer diameter 240 located above and recessed radially inwardly from fourth outer diameter 232 and defines an upward facing shoulder 242. A shoe return spring 243 is disposed about upper slide wedge 214, preferably about fifth outer diameter 240.

A gauge ring 244 is disposed about and is threadedly connected at threaded connection 246 to coupling shoe 180. Gauge ring 244 has an upper end 248 and a lower end 250. Lower end 250 along with lower end 186 of coupling shoe 180 form an upper end 252 of an annular space 254 in which shoe return spring 243 is housed. The lower end 256 of annular space 254 is defined by a pusher shoe retainer 258. Pusher shoe retainer 258 has an upper end 260 that defines lower end 256 of annular space 254. A spring cover 262 defines the radial outer boundary of annular space 254. Cover 262 is attached to pusher shoe retainer 258 with a screw or other fastener and extends upwardly beyond upper end 252 of annular space 254. The gauge ring 244 can move or slide relative to cover 262. Pusher shoe retainer 258 is connected to a pusher shoe 264 at threaded connection 266.

Pusher shoe 264 has head portion 268 defined at a lower end 270 thereof. Pusher shoe 264 has an inner surface 272 defining a first inner diameter 274, a second inner diameter 276 and a third inner diameter 278. Fourth outer diameter 232 of upper slide wedge 214 is slidably and sealingly received in third inner diameter 278. Shoe return spring 243 is in compression so that head portion 268 of pusher shoe 264 maintains engagement with a seal assembly 280 which is disposed about outer mandrel 58 below pusher shoe 264, when packer 10 is in its set or unset position.

Seal assembly 280 may comprise a sealing element 282 having an inner or first axial surface 284 and an outer or second axial surface 286. Sealing element 282 is preferably formed from an elastomeric material such as, but not limited to those available under the trade-names, NBR, FKM, VITON® or the like. However, one skilled in the art will recognize that depending on the temperatures and pressures to be experienced, other materials may be used without departing from the scope and spirit of the present invention. Sealing element 282 has a first or upper end 288 and a second or lower end 290. First end 288 defines a first or upper radial surface 292 and second end 290 defines a second or lower radial surface 294. Seal assembly 280 further includes anti-extrusion jackets 296 which mav comprise a first or upper anti-extrusion jacket or element 298 and a second or lower anti-extrusion jacket or element 300. Seal assembly 280 may further include bridge elements 302 and 304 at the upper and lower ends of sealing element 282. The details of bridge elements 302 and 304 along with the details of sealing element 282 and anti-extrusion jackets 298 and 300 are set forth in the '117 patent.

A lower slide wedge 306 is disposed about outer mandrel 58 below seal assembly 280, and has an upper end 308, a lower end 310 and an inner surface 312 defining an inner diameter 314. Lower slide wedge 306 is closely received about and sealingly engages outer packer mandrel 58. Upper end 308 of slide wedge 306 is positioned below lower end 290 of seal element assembly 282 when packer apparatus 10 is in its unset position 24.

Lower slide wedge 306 has an outer surface defining angular seal engaging surface 315 which may be referred to as a ramp or ramp surface 315. Ramp surface 315 extends downward from upper end 308 of slide wedge 306 and radially outwardly from inner surface 312 thereof, and thus radially outwardly from outer packer mandrel 58. Ramp surface 315 may have a first ramp portion 316 and a second ramp portion 318 extending downwardly from first ramp portion 316. Ramp 315 terminates at an upward facing shoulder 320.

The outer surface of lower slide wedge 306 defines a first outer diameter 322. Shoulder 320 extends between ramp surface 315 and first outer diameter 322. First outer diameter 322 extends downwardly from shoulder 320 and terminates at an upward facing shoulder 326 which is defined by and extends between first outer diameter 322 and a second outer diameter 328. Second outer diameter 328 extends downwardly from shoulder 326 and terminates at an upward facing shoulder 330 which is defined by and extends between second outer diameter 328 and a third outer diameter 332. Third outer diameter 332 extends downwardly and terminates at a downward facing shoulder 334 defined by and extending between third outer diameter 332 and a fourth outer diameter 335. Fourth outer diameter 335 is recessed radially inwardly from third outer diameter 332.

A lower pusher shoe 336 is disposed about lower slide wedge 306 and has an upper end 337 and a lower end 338. A head portion 339, like head portion 268 of upper pusher shoe, is defined at upper end 337. Head portion 339 engages the lower end of seal assembly 280. Lower pusher shoe 336 is threadedly connected to a lower pusher shoe retainer 340 having an upper end 342 and a lower end 344. A lower shoe return spring 346 is disposed about lower slide wedge 306 in an annular space 348. Annular space 348 has an upper end 350 defined by lower end 344 of lower pusher shoe retainer 340, and has a lower end 352 defined by a spacer 354 having upper end 356 and lower end 358. A spring cover 359 is connected to lower pusher shoe retainer 340 with a screw or other fastener known in the art and extends downwardly therefrom such that it is disposed about spacer 352 and covers annular space 348.

An upper barrel slip wedge 360 has upper end 362 and lower end 363, and is threadedly connected at upper end 362 to lower slide wedge 306. A lower gauge ring 364 is disposed about upper barrel slip wedge 360 and is threadedly connected thereto. Lower gauge ring 364 has an upper end 366 which, along with upper end 362 of upper barrel slip wedge 360 engages lower end 358 of spacer 354. Upper barrel slip wedge 360 comprises a part of a barrel or assembly 368 which includes upper barrel slip wedge 360, a barrel slip 370 and a lower barrel slip wedge 372.

Upper barrel slip wedge 360 has an inner surface 374 closely received about ratchet mandrel 100. Upper barrel slip wedge 360 is initially connected to ratchet mandrel 100 with a shear pin 376. Upper barrel slip wedge 360 has plurality of radial ports 378 defined therethrough communicated with radial ports 110, which are in turn communicated with annular passageway 136. Thus, a flow path is created such to allow for pressure equalization around seal assembly 280 through radial ports 210, into annular passageway 205, through ports 88 and then into annular passageway 136 to radial ports 110 and radial ports 378. Upper barrel slip wedge 360 has a plurality of upper wedge cones 380 defined on the exterior thereof.

Lower barrel slip wedge 372 has an upper end 382, a lower end 384 and an inner surface 386 disposed about ratchet mandrel 100. Lower barrel slip wedge 372 is initially attached to ratchet mandrel 100 with shear pins 388. A plurality of wedge cones 390 are defined on the exterior of lower barrel slip wedge 372.

Referring now to FIGS. 4–7 and 10, barrel slip 370 comprises a barrel slip body 392 having an exterior or outer surface 394 and an interior or inner surface 396. The barrel slip body 392 is substantially cylindrical when the barrel slip 370 is in the unset position 24. Interior 396 comprises a series of frustoconical surface cones, or slip cones 398 and 400, respectively. Upper slip cones 398 are positioned adjacent to and generally complementary to upper wedge cones 380 on upper barrel slip wedge 360, while the lower slip cones 400 are positioned adjacent to and generally complementary with the lower wedge cones 390 on lower barrel slip wedge 372. Spacing of the cones, the progressive loading of the slip along with further details of the interior of the barrel slip and the upper and lower barrel slip wedges is set forth in the '102 patent.

Barrel slip body 392 has an upper end 402, a lower end 404 and a longitudinal central axis 406. Barrel slip body 392 has a plurality of longitudinal slots 408 extending from the lower end thereof and terminating near the upper end thereof and has a plurality of longitudinal slots 410 extending from the upper end thereof and terminating at a point near the lower end of the barrel slip body. Longitudinal slots 408 and 410 define a plurality of barrel slip anchors 412 mounted for radial movement. Barrel slip body 392 has a plurality of openings 414 defined in the outer surface thereof. Openings 414 have a plurality of inserts 416, which are preferably tungsten carbide inserts 416 received therein.

Inserts 416 are preferably cylindrical discs having an outer end 418, an inner end 420. Openings 414 are oriented such that inserts 416 when received therein will extend radially outwardly past a radially outermost portion of outer surface 394 and will define a plurality of gripping edges 422 including upward facing gripping edges 424 and downward facing gripping edges 426. Openings 414 thus include a plurality of openings 428 having a longitudinal axis 430 and plurality of openings 432 having a longitudinal axis 434. Openings 428 are oriented such that longitudinal axis 430 may be said to be angled upwardly from a radial axis 436 that is perpendicular to longitudinal axis 406 to define an angle 437. Thus, openings 428 are upwardly angled and the inserts 416 received therein may be said to be upwardly angled inserts 429 to define downward facing gripping edges 426. Longitudinal axis 434 is angled downward such that openings 432 are downwardly angled and inserts 416 received therein may be referred to as downwardly angled inserts 433 to define the upward facing gripping edges 424. Longitudinal axis 434 and radial axis 436 define the angle 439 which is preferably the same, or very nearly the same, as the angle 437.

Preferably, barrel slip body 392 has an upper portion 440, a central portion 442 and a lower portion 444 wherein upwardly angled inserts 429 defining downward facing gripping edges 426 are received in upper portion 440 and downwardly angled inserts 433 defining upward facing gripping edge 424 are received in lower portion 444. Central portion 442 is the portion between upper and lower portions 440 and 444, respectively, wherein no openings are defined. Although shown in the preferred embodiment as the geometric center, the center portion does not have to be the geometric center and it is simply that portion between upper and lower portions 440 and 444, respectively, having no openings or inserts.

The orientation of the inserts 416 and the number of inserts placed in the barrel slip body 392 is such that the body may be expanded to grippingly engage and hold the packer 10 in place and at the same time limiting damage to the casing 25. By utilizing a separate barrel slip body and barrel slip inserts, different materials may be utilized for the barrel slip body and the inserts. When a barrel slip having carburized tips is utilized for high temperature, high pressure applications, a carburized grade of steel, such as 1018 or 8620 heat-treated alloy steel is typically used for the barrel slip. Heat-treated alloy steel of that type typically has an 80,000 psi yield strength and may have a tendency to creep. Such yield strength alloy steels may, after being set in such extreme conditions temper slightly so that the barrel slip keeps its expanded shape, and may drag against the casing as it is pulled upwardly or lowered in the well. Thus, for packers that will be repetitively set and unset in wellbores having temperatures up to and exceeding 400° F. and the extreme pressures set forth herein, it is preferable to use steel with a higher yield strength. With the present application a heat treated alloy steel having a 125,000 psi minimum yield strength can be used since separate carbide inserts are used to grip the casing as opposed to carburized teeth or gripping edges defined on the barrel slip body itself. One benefit in using a higher yield strength alloy is that it is less likely to temper and take a different shape as it is set and the inserts are urged into the casing.

The orientation of the carbide inserts is such that penetration of the inserts into the casing is minimal. The angle of inserts 416 can be any desired angle to provide sufficient gripping engagement, and in the embodiment shown, angles 437 and 439 are preferably approximately 15°±½°. The inserts 416 are held in place in openings 414 by brazing. The outermost portion of each insert 416 preferably extends outwardly from the outer surface 394 of barrel slip body 392 by about 0.040±0.005 in. By providing a large number of inserts over the length and circumference of the barrel slip body, the slip to casing load can be spread over a large area. Thus, when the barrel slip engages the casing, the inserts, or buttons will only minimally penetrate the casing and will still hold the apparatus in place. The casing penetration will be slightly visible, but will be measurably and noticeably less than the penetration that occurs when typical mechanical slips are used to carry the weight of a tool and to hold a tool in place in a well. The mechanical slip in the present invention is used primarily to provide an initial grip to the casing so that the barrel slip can be set, and the load in the well is carried primarily by the barrel slip.

A plurality of T-bars, and preferably four T-bars 446 are disposed about ratchet mandrel 100 and are received in slots 118 defined therein. T-bars 446 have an upper end 447 and a lower end 448. T-bars 446 have a pair of openings defined in an upper surface thereof so that a fastener may be received therein.

Figure 8:
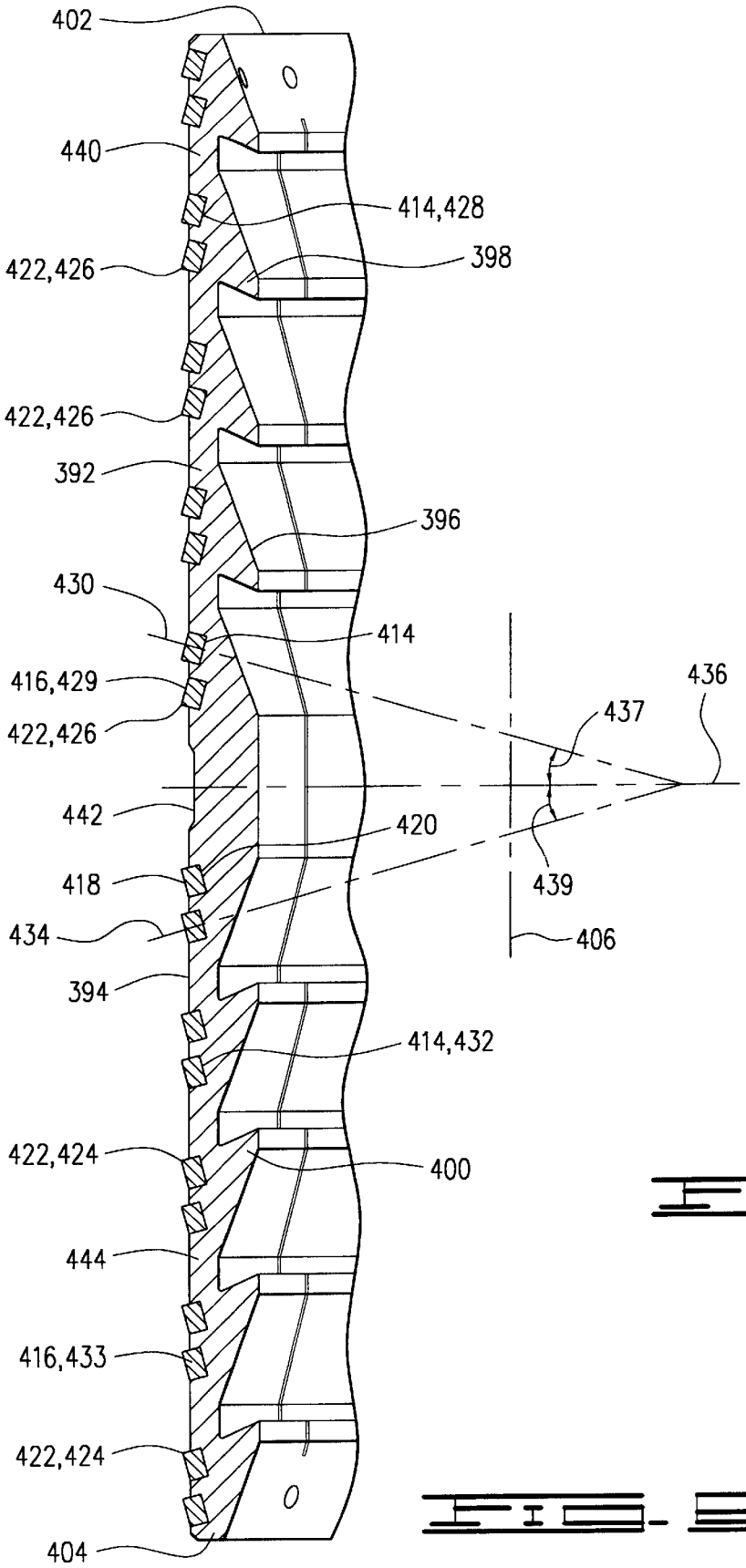
FIG. 8 is a section view from line 8—8 of FIG. 2F.
Figure 7:
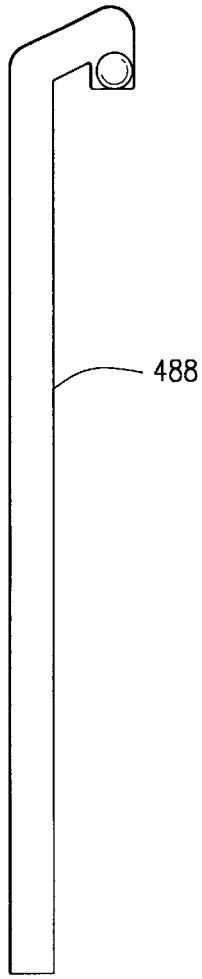
FIG. 7 is a representation of the J-slot.
Figure 8:
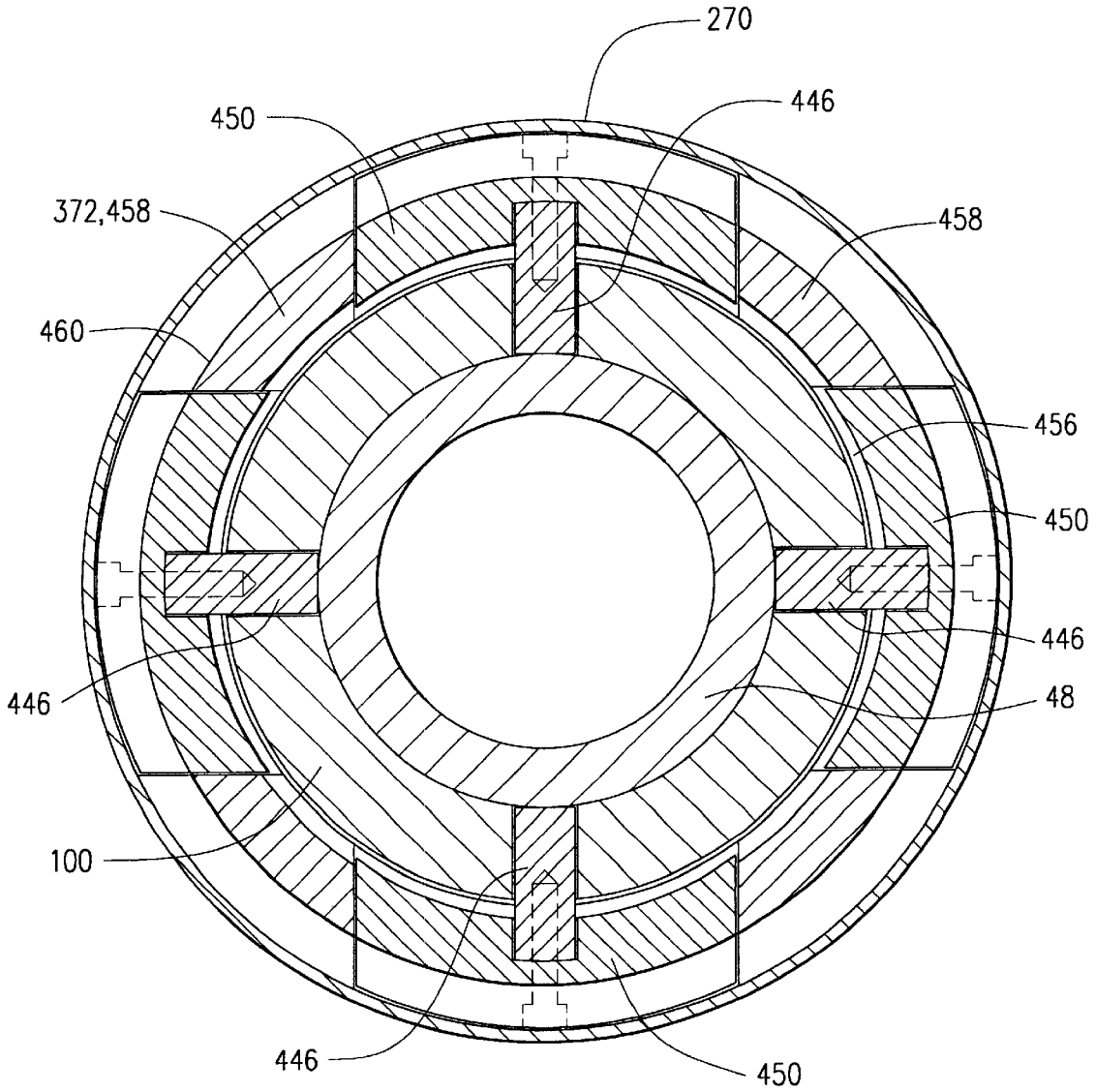
Figure 13:
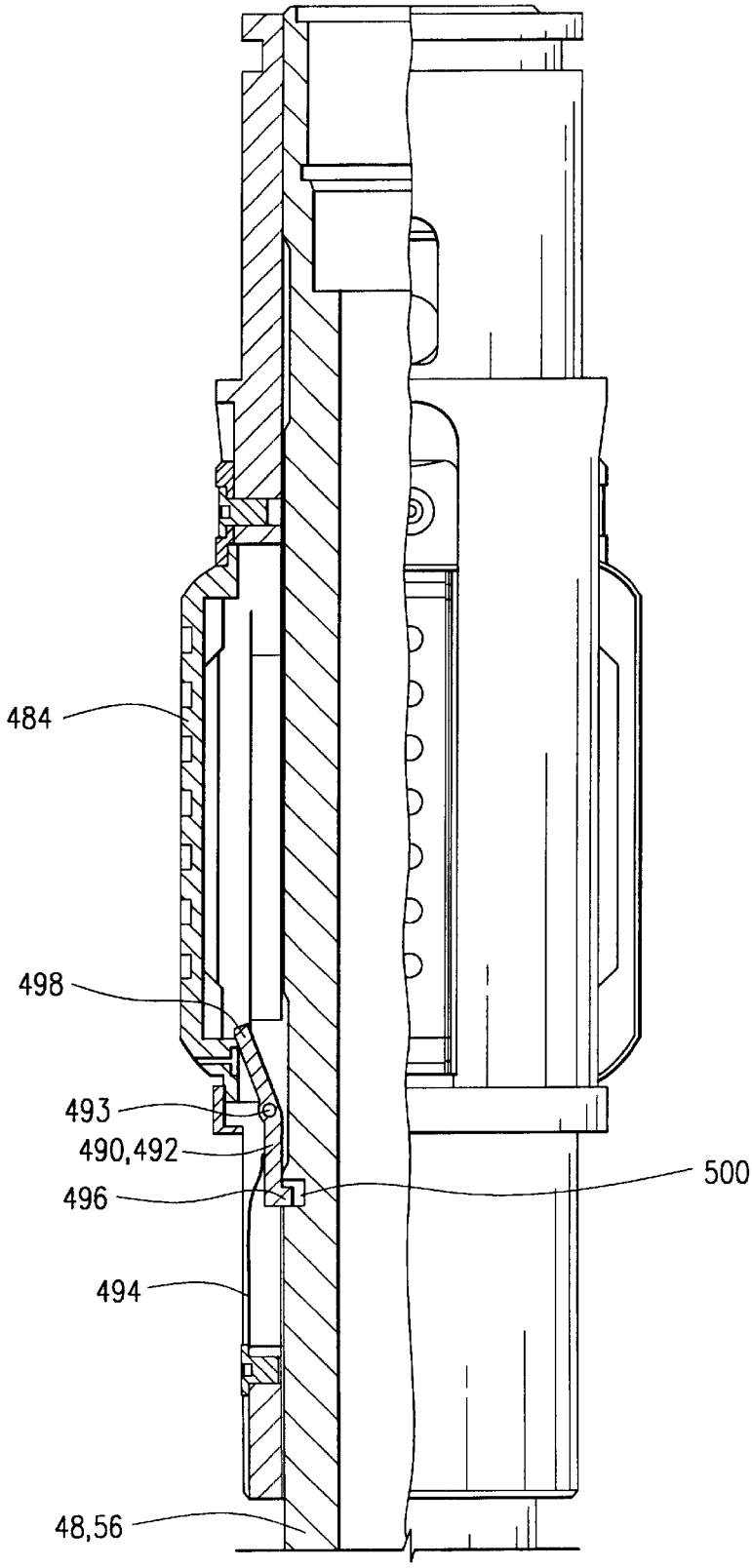
Figure 10:
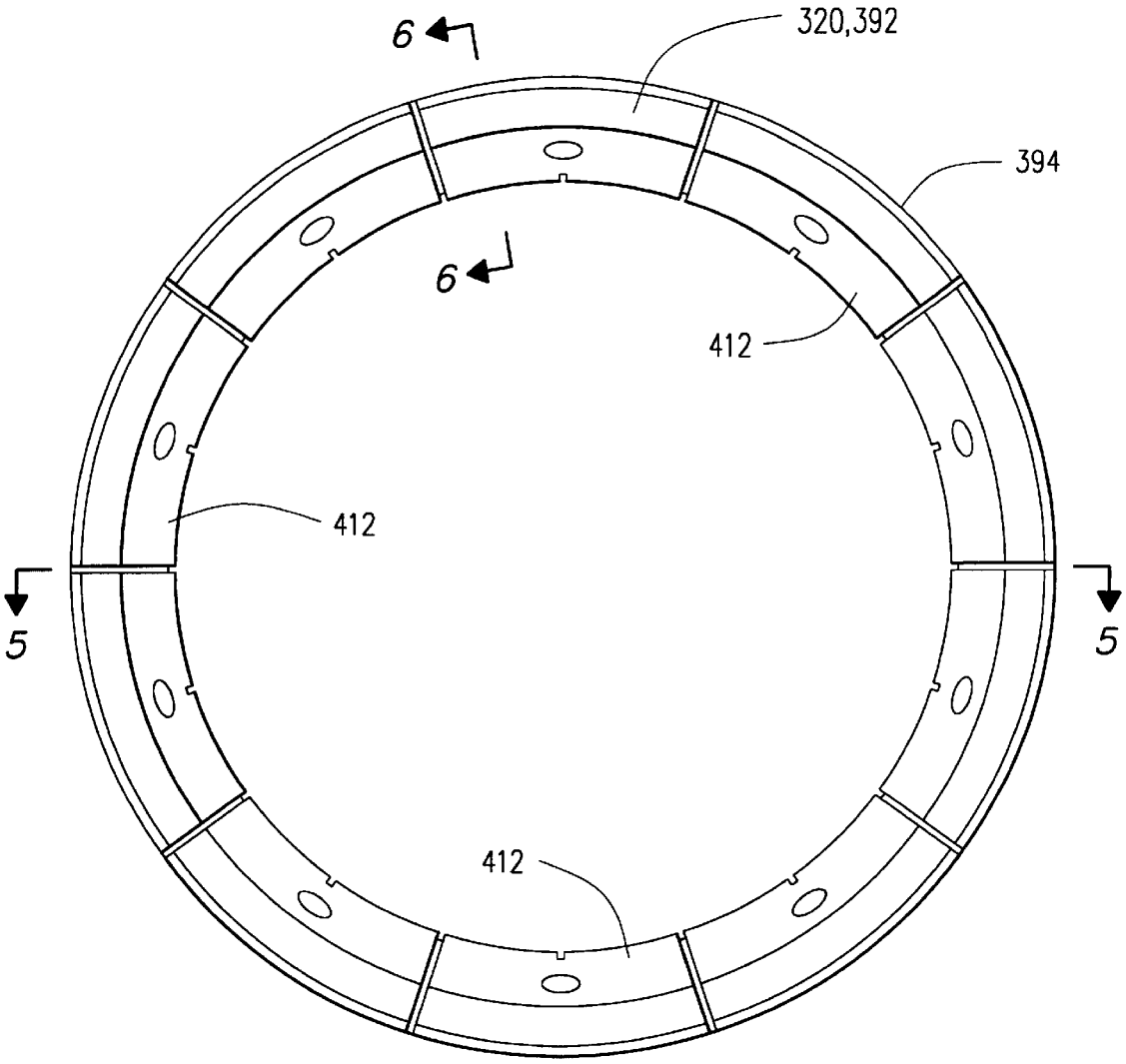
FIG. 10 is an end view of the barrel slip body of the present invention.

A plurality of ratchets 450, and preferably four ratchets 450 are disposed about ratchet mandrel 100. Ratchets 450 have a plurality of ratchet teeth 451 defined thereon for engaging ratchet teeth 120 on ratchet mandrel 100. Ratchets 450 have an upper end 452 and a lower end 453. Ratchets 450 are connected to T-bars 446 with fasteners 454. The arrangement of the ratchets is better shown in FIG. 8. As shown therein, lower barrel slip wedge 372 has a plurality of openings 456, and preferably four openings 456 defined therethrough. Ratchets 450 are received in openings 456. Openings 456 are separated by bands 458 having grooves 460 defined therein. Grooves 460 are aligned with grooves 4641, which are defined in the upper surface 466 of ratchets 450. A ratchet spring 468 is disposed in grooves 460 and 464. A ratchet spring cover 470 is disposed about lower barrel slip wedge 372 and covers ratchets 450. When packer 10 is in its unset position 24, T-bars 446 engage outer diameter 65 and prevent ratchet teeth 451 on ratchets 450 from engaging teeth 120 on ratchet mandrel 100.

A mechanical slip assembly 471 is disposed about inner mandrel 56 below ratchet mandrel 100. Mechanical slip assembly 471 is a type known in the art and thus includes a mechanical slip wedge 472 engaging a plurality of mechanical slips and preferably three mechanical slips 474 therebelow. Mechanical slips 474 are attached to a split ring collar 476 that is in turn attached to a drag block assembly 478. Mechanical slip wedge 472 is threadedly connected to lower barrel slip wedge 372 at threaded connection 480.

Drag block assembly 478 may be of a type known in the art and thus may include a drag block sleeve 482 having a drag block 484 connected thereto with drag springs 486 disposed therein. Drag block sleeve 482 has at least one and preferably a plurality of J-slots 488 defined therein to receive lugs 96 defined on mandrel 56. Although drag block assembly 478 is in most aspects identical to prior art drag block assemblies, it may include a novel liner lock 490 as shown in FIG. 9. Liner lock 490 has a liner lock arm 492 and a liner lock spring 494. Liner lock spring 494 is attached to drag block sleeve 482 with a fastener of the type known in the art. Liner lock arm 492 has a head portion 496 defined thereon and a foot portion 498. Liner lock arm 492 is pivotally attached to drag block sleeve 482 with a pin 493 or other mechanism known in the art. When packer 10 is in unset position 24, liner lock spring 494 will engage the liner lock arm 492 such that head portion 496 is held in place in a groove 500 defined in inner mandrel 56. Head portion 496 will not be removed from groove 500 until at proper amount of compression is applied to drag blocks 484 such that they will engage foot portion 498 causing liner lock arm 492 to pivot and head portion 496 to be removed from groove 500, thus allowing relative movement between mandrel 48 and drag block sleeve 482.

Packer 10 is shown in FIGS. 2A through 2H in its initial running position and thus is in unset position 24. The operation of packer 10 is as follows. Packer 10 may be connected at its upper end to tubing 34 and lowered into a well, such as well 15. Any desired type of equipment known in the art may be attached to the lower end of mandrel 48 so that a desired operation may be performed. As is well-known in the art, packer 10 may be lowered through different sizes of casings such that the drag block assembly 478 can be bumped by the upper end of different diameters of casing as it is being lowered into the hole. Liner lock 490 will prevent premature movement of the mandrel relative to the drag block and thus is a means for preventing apparatus 10 from prematurely moving from its unset position 24 to its set position 22. Drag block assembly 478 will be designed with a preselected outer diameter so that it will be engaged and compressed by casing also having a predetermined or preselected diameter such as casing 25. Once drag block 484 engages casing 25 it will compress such that foot portion 498 of liner lock arm 492 is engaged by the drag block sleeve 482 and head portion 496 is removed from groove 500 to allow for movement of the mandrel 48 relative to the drag block 484. Inner mandrel 56 will not, however, move downwardly relative to drag block 484 because of the J-slot and lug arrangement.

Once packer apparatus 10 has reached a desired location in the well 15, the packer apparatus 10 can be moved from its unset position 24 to set position 22. In order to do so, upward pull is applied to tubing 34, and tubing 34 is rotated so lugs 96 will be rotated and can travel downwardly in the long leg of J-slots 488. Inner mandrel 56 will move downwardly and will slide in packer body 50 until downward facing shoulder 44 engages upper end 152 of cap 150. When inner mandrel 56 moves downwardly, T-bars 446 will be urged radially inwardly by ratchet spring 468 so that they engage outer diameter 63. Ratchets 450 will likewise be urged radially inwardly so that ratchet teeth 451 engage ratchet teeth 120. When ratchet teeth 451 and 120, respectively, are engaged, ratchet mandrel 100 can move downward relative to ratchet 450, but is prevented from upward movement relative thereto.

Continued downward load will cause mechanical slip wedge 472 to urge mechanical slips 474 outwardly to engage casing 25. After mechanical slips 474 engage casing 25, shear pins 376 and 388 will break. Lower barrel slip wedge 372 will not move downwardly since it is held in place by mechanical slip assembly 470. Continued downward motion will thus urge upper barrel slip wedge 360 downwardly which will urge barrel slip, 370 downwardly. The barrel slip body 392 will be expanded radially outwardly by the relative movement between wedge cones 380 and 390 on barrel slip wedges 360 and 372 and upper and lower slip cones 398 and 400 on barrel slip body 392. Radial expansion will cause inserts 416 to engage and grip casing 25. The continued downward load will also cause seal assembly 280 to become compressed between upper and lower slide wedges 214 and 306, respectively, and to be expanded radially outwardly to engage and seal against casing 25. Once packer apparatus 10 is in its set position 22, production or other operations may be performed. The engagement of ratchet 450 with ratchet mandrel 100 will prevent packer 10 from premature unsetting, and capture the setting force/energy.

If it is desired to move packer apparatus 10 and reset it in the well at a different location, an upward pull is applied. Inner mandrel 56 will move and can be rotated to place lugs 96 in the short leg of the J-slots 488. When an upward pull is applied to inner mandrel 56, T-bars 446 will be engaged by outer diameter 65 on inner mandrel 56 and will thus urge T-bars 446 and ratchets 450 to disengage ratchet teeth 451 and 120, respectively. Upward pull will also allow mechanical slips 474 to retract radially inwardly and will allow barrel slip body 392 to retract radially inwardly such that engagement from the casing 25 is released.

Likewise, seal assembly 280 will retract radially inwardly so that there is clearance between seal assembly 280 and casing 25. The packer 10 is again in unset position 24. Although the packer apparatus 10 may not be identically positioned as it is in its original, running, unset position, the packer may be said to be in unset position 24 when the seal assembly, and the mechanical and barrel slips are positioned such that the packer 10 may be moved in the well 15 without damaging the packer 10. Once in unset position 24, packer apparatus 10 can be pulled upwardly or moved downwardly in well 15 and can be reset simply by slight upward pull and rotation so that lug 96 is again placed in the long leg of J-slot 488. Inner mandrel 56 may be moved downwardly so that downward facing shoulder 44 again engages cap 150 to apply load to the mechanical slip 474, barrel slip 370 and seal assembly 280 so that each will engage the casing 25. Packer apparatus 10 can be set and unset in this manner as many times as is desired. Thus, the present invention provides a resettable packer that can be utilized in high temperature, high pressure environments. The present invention also provides an apparatus which utilizes a mechanical slip in combination with a barrel slip and utilize s a novel barrel slip combination which comprises a barrel slip body and barrel slip inserts or buttons.

Although the invention has been described with reference to a specific embodiment, the foregoing description is not intended to be construed in a limiting sense. Various modifications as well as alternative applications will be suggested to persons skilled in the art by the foregoing specification and illustrations. It is therefore contemplated that the appended claims will cover any such modifications, applications or embodiments as followed in the true scope of this invention.

What is claimed is:

1. A packer apparatus for use in a subterranean well having a casing therein, the packer apparatus comprising:

a packer mandrel;

an expandable seal assembly disposed about said packer mandrel;

an upper expandable slip disposed about said packer mandrel for engaging and gripping the casing; and a lower expandable slip disposed about said packer mandrel below said upper expandable slip for engaging and gripping the casing;

wherein said upper expandable slip is a substantially cylindrical barrel slip comprising:

a radially expandable barrel slip body having an upper end, a lower end, and an outer surface, said barrel slip body having a plurality of openings therein; and inserts disposed in said plurality of openings, said inserts extending radially outwardly from said outer surface of said barrel slip body so that said inserts will engage and grip the casing when said barrel slip body expands radially.

2. The packer apparatus of claim 1, further comprising:

a slip wedge operably associated with said lower expandable slip for urging said lower expandable slip outwardly to engage the casing; and at least one wedge operably associated with said upper expandable slip for urging said upper expandable slip radially outwardly to engage the casing.

3. The packer apparatus of claim 2, wherein said lower expandable slip will engage the casing prior to said upper expandable slip.

4. The packer apparatus of claim 1, further comprising:

a drag block disposed about said packer mandrel, said packer mandrel being slidable relative thereto; and a liner lock, said liner lock being movable from a locked position, wherein said packer mandrel is prevented from moving relative to said drag block, and an unlocked position, wherein said packer mandrel may move relative to said drag block.

5. The packer apparatus of claim 1, said packer apparatus being a resettable packer apparatus, wherein said packer apparatus may be alternated in the well between a set position, wherein said upper and lower expandable slips and said expandable seal assembly engage the casing, and an unset position, wherein said upper and lower expandable slips and said expandable seal assembly are disengaged from the casing.

6. A packer apparatus for use in a subterranean well having a casing therein, the packer apparatus comprising:

a packer mandrel;

an expandable seal assembly disposed about said packer mandrel;

a drag block disposed about said packer mandrel, said packer mandrel being slidable relative thereto;

a liner lock, said liner lock being movable from a locked position, wherein said packer mandrel is prevented from moving relative to said drag block, and an unlocked position, wherein said packer mandrel may move relative to said drag block;

an upper expandable slip disposed about said packer mandrel for engaging and gripping the casing; and a lower expandable slip disposed about said packer mandrel below said upper expandable slip for engaging and gripping the casing;

wherein one of said upper and lower expandable slips comprises a substantially cylindrical barrel slip, and wherein said liner lock comprises a rocker arm pivotally connected to said drag block, said rocker arm having a locking head defined on an end thereof, wherein in said locked position said locking head is received in a groove in said packer mandrel to prevent said packer mandrel from moving relative to said drag block, and wherein in said unlocked position said locking head is removed from said groove.

7. The packer apparatus of claim 6, wherein insertion of said drag block into a casing having a preselected diameter causes said rocker arm to pivot so that said locking head is removed from said groove.

8. A packer apparatus for use in a subterranean well having a casing therein comprising:

a packer mandrel;

an adapter connected to said packer mandrel, said adapter defining an engagement shoulder; and a packer body disposed about said packer mandrel, said packer mandrel being slidable relative to said packer body, said packer body having a shoulder defined at an upper end thereof, and said packer body comprising:

a drag block for engaging the casing;

a lower slip for gripping the casing, said lower slip located above said drag block; and an upper slip for gripping the casing, said upper slip located above said lower slip, said upper slip comprising a substantially cylindrical barrel slip, wherein said packer mandrel is movable relative to said drag block such that when said drag block engages a casing of a preselected inner diameter, said packer mandrel may be moved so that said engagement shoulder on said adapter will engage said shoulder on said packer body to apply a downward load thereto, wherein said downward load causes said lower slip to expand radially to engage the casing, and wherein continued downward load will cause said upper slip to expand to engage the casing to hold said packer apparatus in place at a desired location in the well.

9. The packer apparatus of claim 8, wherein said packer body includes an upper barrel slip wedge and a lower barrel slip wedge, wherein downward load applied by said adapter to said packer body will cause said upper and lower barrel slip wedges to expand said barrel slip so that said barrel slip engages the casing after said lower slip engages the casing.

10. The packer apparatus of claim 8, wherein said barrel slip comprises:

a barrel slip body; and a plurality of inserts attached to said barrel slip body, wherein said inserts will engage the casing when said barrel slip body is expanded.

11. The packer apparatus of claim 10, said barrel slip body having a plurality of openings therein, said inserts being received in said openings and extending radially outwardly from the radially outermost portion of said barrel slip body.

* * * * *